United States Patent [19]

Yamamoto et al.

[11] Patent Number: 4,571,122

[45] Date of Patent: Feb. 18, 1986

[54] PIPE LAYING APPARATUS

[75] Inventors: Hiroshi Yamamoto, Ibaraki; Shuichi Satoh, Sendai; Yoshiyuki Iwai, Takamatsu; Osamu Ae, Kyoto; Masao Suda, Tsuchiura; Minoru Shiozaki, Ibaraki; Kiyoshi Tsuchiya, Ibaraki; Manabu Nakano, Ibaraki; Kojiro Ogata, Ishioka; Naoki Miyanagi, Ibaraki; Kozo Ono, Toride; Nobuyuki Tobita, Mito, all of Japan

[73] Assignees: Nippon Telegraph & Telephone Public Corp.; Hitachi Construction Machinery Co., Ltd., both of Tokyo, Japan

[21] Appl. No.: 655,528

[22] Filed: Sep. 28, 1984

[30] Foreign Application Priority Data

Feb. 24, 1984 [JP] Japan ..... 59-32691

[51] Int. Cl.[4] ..... F16L 1/00

[52] U.S. Cl. ..... 405/184; 175/55; 175/62; 299/58; 405/143

[58] Field of Search ..... 405/138, 141, 143, 146, 405/154, 184; 175/55, 61, 62, 65; 299/55, 58

[56] References Cited

U.S. PATENT DOCUMENTS 2,302,073 11/1942 Tracy ..... 299/55 X
2,988,348 6/1961 Robbins ..... 299/58 X
4,024,721 5/1977 Takada et al. ..... 405/184
4,122,683 10/1978 Follert et al. ..... 405/143 X
4,176,985 12/1979 Cherrington ..... 405/184
4,534,676 8/1985 Saito ..... 405/184

*Primary Examiner*—David H. Corbin
*Attorney, Agent, or Firm*—Antonelli, Terry & Wands

[57] ABSTRACT

A pipe laying apparatus including an excavator propulsion unit located in a starting pit. The excavator includes an excavator body having a first axis, an excavating tool having a second axis and located at a forward end portion of the excavator body, and injection ports formed in the excavating tool for injecting a viscosity imparting liquid into soil as excavated. The excavator body has a rearward portion thereof disposed adjacent pipes to be laid each having an outer diameter smaller than the outer diameter of the excavating tool and positioned at a rearward end thereof against the propulsion means, and is operative to excavate the earth to form a hole therein while the viscosity imparting liquid is being injected through the injection ports into the soil as excavated to thereby produce a viscosity imparting liquid containing soil which is conveyed rearwardly through an outer periphery of the excavator body while being filled in an annular clearance defined between the hole formed in the earth and the pipes to be laid, so that the pipes can be successively laid as the excavator body and the pipes are propelled forwardly by the propulsion unit.

6 Claims, 15 Drawing Figures

PIPE LAYING APPARATUS

BACKGROUND OF THE INVENTION

This invention relates to pipe laying apparatus, and more particularly it is concerned with a pipe laying apparatus suitable for laying pipes of relatively small diameter.

Nowadays, a propulsion process is becoming more popular as a process for laying pipes of relatively small diameter or a diameter of less than 1000 mm than an opencut process that has hitherto been adopted. In the propulsion process, propulsion means, such as hydraulic cylinders, are installed in a starting pit for pressing pipes to be laid at a rear end thereof to propel same while forcing the earth ahead of the pipes to be compacted, to thereby lay the pipes underground. This propulsion process is specifically referred to as a compaction type system. Some disadvantages are associated with the compaction type system. That is, the pipes to be laid under ground are merely pressed at the rear thereof by the hydraulic cylinders, so that a resistance of high magnitude is offered to the movement of the pipes by a force of friction acting between the pipes and the earth through which they are propelled. This makes it necessary to use hydraulic cylinders capable of producing a pressing force of high magnitude. Also, the pipes tend to be damaged because of a force of high magnitude exerted thereon, and the pipes propelled tend to be deflected from the designed path of movement with a low degree of directional precision.

Proposals have been made to develop improved pipe laying apparatus by obviating the aforesaid disadvantages of the prior art. They include a pipe laying apparatus of a rotation excavation type as disclosed in Japanese Patent Application Laid-Open No. 29797/82, which includes an excavator equipped with a rotary excavating tool and excavates the earth by the excavator while propelling pipes to be laid by hydraulic cylinders to thereby lay the pipes underground and a pipe laying apparatus of a lateral vibration excavation type as disclosed in Japanese Patent Application Laid-Open No. 123393/82 and No. 135299/83, which incudes a vibration excavator attached to a formed end of the leading pipe and excavates the earth by the vibration excavator while propelling pipes to be laid by hydraulic cylinders, the vibration excavator having a shaft mounting eccentric weights located at right angles relative to the center axes of the pipes to be laid to produce lateral vibration with rotation of the shaft.

In the pipe laying apparatus of the rotation excavation type the earth is excavated by rotating the rotary excavating tool while a viscosity imparting liquid is being injected into the earth in the vicinity of the surface at which excavation is carried out, and at the same time the soil as excavated is mixed with the viscosity imparting liquid and agitated to produce a viscosity imparting liquid containing soil which is conveyed under pressure toward the starting pit through an annular passage defined between a hole formed by excavation and the pipes to be laid. In the pipe laying apparatus of the vibration excavation type, a forward end portion of the excavator is caused to vibrate to crush the earth into minuscule particles while a viscosity imparting liquid is being injected into the earth in the vicinity of the surface at which excavation is carried out, and at the same time the soil as excavated is mixed with the viscosity imparting liquid and agitated by the vibration of the excavator to produce a viscosity imparting liquid containing soil which is conveyed under pressure toward the starting pit through an annular passage defined between the hole formed by excavation and the pipes to be laid.

The pipe laying apparatus of the rotation excavation type can have application in the earth layers such as sand, clay, etc., but when it is a gravel layer including solid particles such gravels, the problem arises that it is difficult to convey the excavated soil toward the starting pit for discharging thereof. Meanwhile, the pipe laying apparatus of the vibration excavation type offers the advantage that even if the earth contains solid materials such as gravel, they can be embedded in the earth by the vibration while allowing only the viscosity imparting liquid containing soil of high viscosity to be discharged to the starting pit. However, this type encounters the problem that when the earth layer is clay, it is difficult to improve operation efficiency and achieve a high excavation speed unless the amplitude of vibration of the excavator is increased, while if the amplitude is increased, the vibration of the ground surface increases in magnitude.

Proposals have been made, as described in Japanese Patent Application Laid-Open No. 44194/83, for example, to use a pipe laying apparatus which possesses the merits of both the rotation excavation type and the vibration excavation type by mounting a vibrator in the excavator body having a rotary excavating tool for allowing rotation and vibration excavations to be effected, so that the apparatus can cope with a wide range of earth layers including sand, clay, gravel, etc.

Meanwhile, the pipe laying apparatus of the above-mentioned vibration excavation type also suffers the disadvantage that since the excavator body vibrates as a whole, the vibration of the excavator is transmitted to the pipes to be laid which are rigidly connected to the excavator body. Thus, the pipes to be laid are caused to vibrate simultaneously as the excavator body vibrates, and therefore it becomes necessary to increase the size of the excavator to increase the magnitude of the vibration produced.

The pipe laying apparatus of the combined rotation and vibration excavation type as disclosed in Japanese Patent Application Laid-Open No. 44194/83, noted hereinabove, has the same disadvantage as the pipe laying apparatus of the vibration excavation type since the vibrator mounted inside the excavator body causes the excavator body to vibrate as a whole.

On the other hand, vibratory excavators have been developed which are provided with means for avoiding transmission of vibration to pipes to be laid. This type of excavator is disclosed in Japanese Patent Application Laid-Open No. 146896/82, for example, which comprises a cylindrical support, a vibrator generally of a cylindrical shape and having a conical forward end portion, the cylindrical portion being coaxially inserted in the cylindrical support, a plurality of shock absorbing small-diameter rods mounted between a rearward end of the vibrator and a forward end of the support to connect them together in such a manner that the small-diameter rods are arranged in a circle concentric with the support and the cylindrical portion of the vibrator, and a bellows of resilient material mounted between the forward end of the support and a back surface of the conical forward end portion of the vibrator. The vibrator has a rotary shaft journalled in the cylindrical portion thereof coaxially therewith, and an eccentric weight is mounted on the rotary shaft which is connected to a drive motor. A pipe laying apparatus equipped with this type of vibratory excavator offers the same advantages as the first-mentioned pipe laying apparatus of the vibration excavation type of the prior art.

Moreover, the vibrator excavator noted hereinabove is equipped with shock absorbing small-diameter rods interposed between the support and vibrator. This causes a thrust applied to the pipes to be laid by hydraulic cylinders to be transmitted to the vibrator, while, the vibration of the vibrator (vibration which is at right angles to the axes of the support and the cylindrical portion of the vibrator) is absorbed by the small-diameter rods which are flexed at right angles to the axes of the support and the cylindrical portion of the vibrator, so that the vibration of the vibrator is prevented from being transmitted to the pipes to be laid through the support. Stated differently, the vibrator and the pipes to be laid are connected together in flexible coupling through the small-diameter rods and support. This makes it possible to provide improvements in the first-mentioned vibratory excavator of the prior art which suffers the disadvantage that the excavator should be large in size to develop a vibration of high magnitude due to the vibration to be transmitted to the pipes to be laid.

The problem raised with regard to this type of vibratory excavator is that the arrangement whereby a plurality of small-diameter rods are mounted between the support and vibrator to bear the thrust applied by the hydraulic cylinders has the risk that the small-diameter rods might be ruptured when the thrust applied thereto is high in magnitude.

SUMMARY OF THE INVENTION

This invention has as its object the provision of a pipe laying apparatus, combining the merits of the pipe laying apparatus of the rotation excavation type and the pipe laying apparatus of the vibration excavation type, which can have application in a wide range of earth layers including a sand layer, a clay layer, a gravel layer, which can prevent the vibration for excavation from transmitting to pipes to be laid to minimize the waste of power for generating the vibration, and which can withstand a thrust of high magnitude.

According to the invention, there is provided a pipe laying apparatus comprising an excavator including an excavator body having a first axis, an excavating tool having a second axis and located at a forward end portion of the excavator body, and injection means formed in the excavating tool for injecting a viscosity imparting liquid into soil as excavated, and propulsion means located in a starting pit, the excavator body having a rearward portion thereof disposed adjacent pipes to be laid each having an outer diameter smaller than the outer diameter of the excavating tool and positioned at a rearward end thereof against the propulsion means, the excavating tool being operative to excavate the earth to form a hole therein while said viscosity imparting liquid is being injected through the injection means into the soil as excavated to thereby produce a viscosity imparting liquid containing soil which is conveyed rearwardly from an outer periphery of the excavator body while being filled in an annular clearance defined between the hole formed in the earth and the pipes to be laid, so that the pipes can be successively laid as the excavator body and the pipes are propelled forwardly by the propulsion means, wherein the excavator comprises: a first rotary shaft journalled in the excavator body for rotation about the first axis; spherical surface seat means interposed between the excavating tool and first rotary shaft and having a sphere center located on the first, the excavating tool being supported through the spherical surface sent means on the first rotary shaft for allowing the excavating tool to swing in a pivotal movement about the sphere center with the second axis extending through the sphere center; means interposed between the excavating tool and first rotary shaft for transmitting rotation of the first rotary shaft to the excavating tool while allowing the excavating tool to swing in pivotal movement about the sphere center, a second rotary shaft journalled in the excavating tool for rotation about the second axis; a pair of eccentric weights mounted on the second rotary shaft and located symmetrically with respect to the sphere center while being displaced from each other by 180 degrees in phase; first drive means connected to the first rotary shaft for driving thereof; and second drive means connected to the second rotary shaft for driving thereof.

Preferably, the first rotary shaft is a hollow shaft, and the second rotary shaft and second drive means are connected together through a flexible shaft extending through the first hollow rotary shaft.

Preferably, the excavating tool comprises a dual cylindrical structure portion having an inner cylindrical portion and an outer cylindrical portion open at a rearward end thereof between the inner and outer cylindrical portions, the inner cylindrical portion having the second rotary shaft journalled therein for rotation, the inner and outer cylindrical portions having a forward end portion of the first rotary shaft inserted therebetween with the spherical surface seat means and rotation transmitting means being located between the outer cylindrical portion and the forward end portion of the rotary shaft.

Preferably, the first rotary shaft is a hollow shaft defining therein a channel in communication with the injection means for allowing the viscosity imparting liquid to be supplied therethrough to the injection means.

Preferably, a flexible cover tube is rotatably supported to extend between the first hollow rotary shaft and flexible shaft with clearances being defined between the shafts and tube and the flexible cover tube having a forward end connected to the inner cylindrical portion of the excavating tool, and the clearance between the first rotary shaft and flexible cover tube being in communication with a clearance between the forward end portion of the first rotary shaft and the inner cylindrical portion of the excavating tool to form a channel for allowing the viscosity imparting liquid to be supplied to the injection means.

Preferably, the inner cylindrical portion of the excavating tool has passages formed therein to communicate the channel to the injection means.

DETAILED DESCRIPTION OF THE PREFERRED EMBODIMENT

Figure 1:
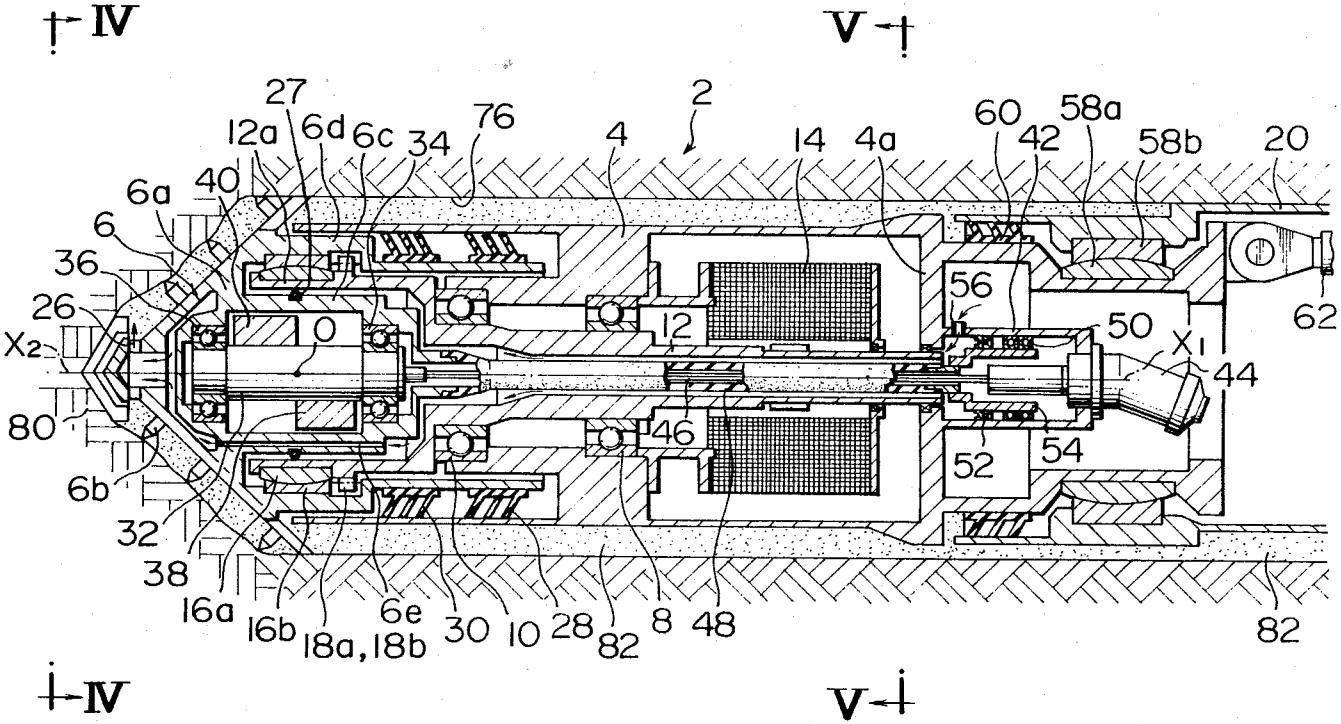
FIG. 1 is a sectional view of the pipe laying apparatus comprising one embodiment of the invention, showing the excavator section thereof.
Figure 2:
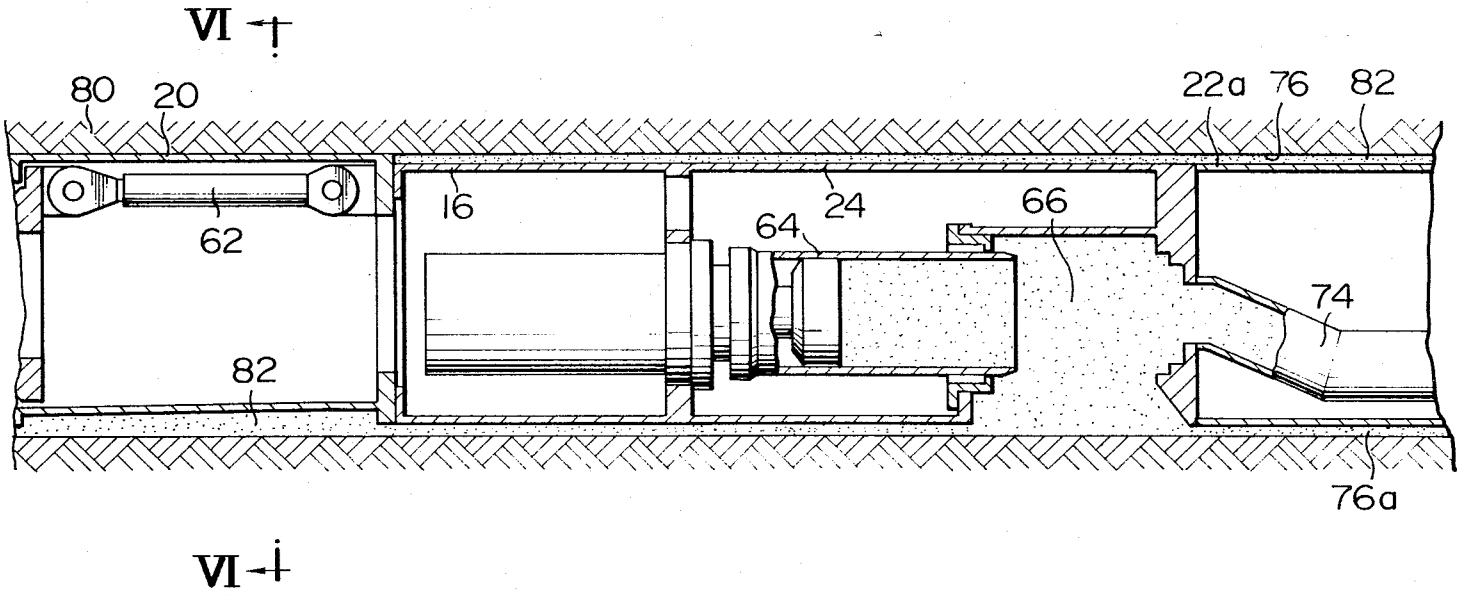
FIG. 2 is a sectional view of the pipe laying apparatus shown in FIG. 1, showing the direction correcting tube connected to the excavator section shown in FIG. 1 and the delivery pump mounting tube connected to direction correcting tube.

Referring to FIG. 1, the pipe laying apparatus according to the invention comprises an excavator generally designated by the reference numeral 2 including an excavator body 4 having a first axis $X_1$, and an excavating tool 6 having a second axis $X_2$.

The excavator body 4 is generally of a cylindrical configuration open at forward and rearward ends, and has a partition plate 4*a* in the vicinity of the rearward end. Journalled by bearings 8 and 10 for rotation about the first axis $X_1$ is a first rotary shaft or hollow rotary shaft 12 extending through the excavator body 4 and associated with a first drive unit 14. The hollow rotary shaft 12 includes a forward end portion 12*a* of increased diameter which is open at its forward end and has a convex spherical surface seat 16*a* and a connection 18*a* situated on its outer periphery. The convex spherical surface seat 16*a* has an outer seat surface of a spherical shape having its sphere center 0 located on the first axis $X_1$ of the excavator body 4.

Figure 4:
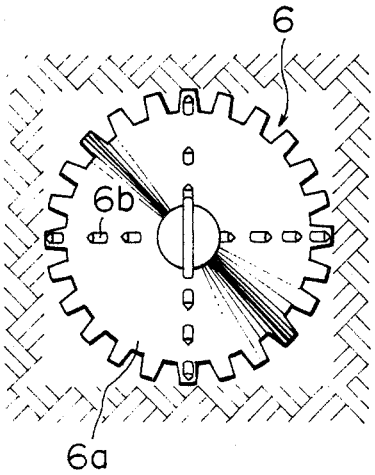
FIG. 4 is a sectional view taken along the line IV—IV in FIG. 1.

Meanwhile, the excavating tool 6 has at its forward end a cone-shaped portion 6*a* of an outer diameter slightly larger than the outer diameters of the excavator body 4 and a direction correcting tube 20, pipes 22*a* and 22*b* to be laid and a delivery pump mounting tube 24 subsequently to be described. The cone-shaped portion 6*a* has attached to its front surface as shown in FIG. 4 a multiplicity of excavating cutters 6, and is formed with viscosity imparting liquid injecting ports 26 in a central portion of its front surface as shown in FIG. 1. Extending rearwardly from the cone-shaped portion 6*a* is a dual cylindrical structure portion having an inner cylindrical portion 6*c* and an outer cylindrical portion 6*d* and open at a reward end thereof between the inner and outer cylindrical portions 6*c* and 6*d*. The inner cylindrical portion 6*c* has viscosity imparting liquid passages 6*e* formed therein in communication with the injecting ports 26, and the outer cylindrical portion 6*d* has a concave spherical surface seat 16*b* and a connection 16*b* situated on its inner perphery, the concave spherical surface seat 16*b* being fitted over the convex spherical surface seat 16*a* and the connection 18*b* engaging the connection 18*a*. The concave spherical surface seat 16*b* has an inner seat surface of a spherical shape concentric with the outer seat surface of the convex spherical surface seat 16*a*.

The connection 18*a* may comprise a plurality of teeth projecting radially outwardly from an outer periphery of the increased diameter forward end portion 12*a* of the hollow rotary shaft 12, and the connection 18*b* may comprise a plurality of teeth formed in a circumferential arrangement in an outer periphery of the outer cylindrical portion 6*d* of the excavating tool 6 and meshing with the teeth of the connection 18*a*. The teeth of the connection 18*b* are larger in width than the teeth of the connection 18*a* to allow the latter to swing in pivotal movement in the former about the sphere center 0.

Thus, the excavating tool 6 of the aforesaid structure is supported through the spherical surface seats 16*a* and 16*b* on the hollow rotary shaft 12 for swinging in pivotal movement about the sphere center 0 with the second axis $X_2$ extending through the sphere center 0. At the same time, the rotation of the hollow rotary shaft 12 is transmitted to the excavating tool 6 through the connections 18*a* and 18*b* while allowing the excavating tool 6 to swing in pivotal movement about the sphere center 0.

Figure 7:
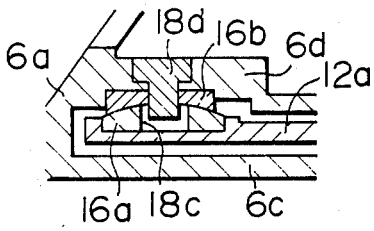
FIG. 7 is a sectional view of a modified constructional form of the connection between the hollow rotary shaft and the excavating tool for transmitting rotation from the former to the later.

As shown in FIG. 7, the connection 18*a* may be in the form of a plurality of notches 18*c* formed in circumferential arrangement in the convex spherical surface seat 16*a*, and the connection 18*b* may be in the form of a plurality of teeth 18*d* attached to the concave spherical surface seat 16*b* and each extending radially inwardly into one of the notches 18*c* and meshing with walls defined between the notches 18*c*. The notches 18*c* are larger in width than the teeth 18*d* to allow the convex spherical surface seat 16*a* to swing in pivotal movement about the sphere center 0.

Referring to FIG. 1 again, an 0-ring seal 27 is mounted between the inner cylindrical portion 6*c* of the excavating tool 6 and the forward end portion 12*a* of the hollow rotary shaft 12 for preventing a viscosity imparting liquid from flowing out to the spherical surface seats 16*a* and 16*b*. Also, seals 28 and 30 are mounted between an outer periphery of the outer cylindrical portion 6*d* and an inner periphery of the excavator body 4 for preventing the entry of soil as excavated in the interior of the excavator 2.

A second rotary shaft 32 is journalled by bearings 34 and 36 within the inner cylindrical portion 6*c* of the excavating tool 6 for rotation about the second axis $X_2$. A pair of eccentric weights 38 and 40 are mounted on the second rotary shaft 32 and located symmetrically with respect to the sphere center 0 while being displaced from each other by 180 degrees in phase. The second rotary shaft 32 is connected to a second drive unit 44 mounted on a bracket 42 secured to the partition plate 4*a*, through a flexible shaft 46 extending through the hollow rotary shaft 12.

Figure 5:
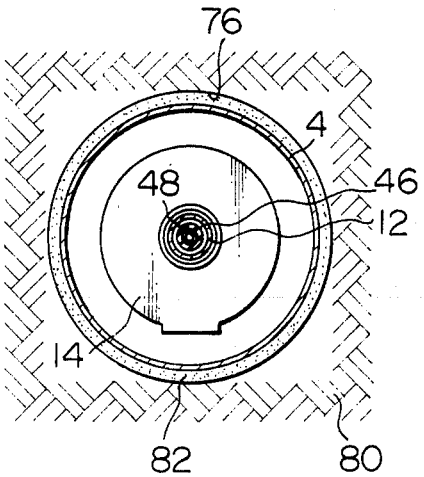
FIG. 5 is a sectional view taken along the line V—V in FIG. 1.

Referring to FIG. 5, also, a flexible cover tube 48 extends between the hollow rotary shaft 12 and flexible shaft 46 in such a manner that clearances are defined between the shaft 12 and tube 48 and between the tube 48 and shaft 46, respectively. As shown in FIG. 1, the cover tube 48 is connected at its forward end to a rearward end of the inner cylindrical portion 6*c* of the excavating tool 6 and at its rearward end to a rotary support member 54 journalled by bearings 50 within the bracket 42 and having a seal 52 mounted to divide the interior of the bracket 42 into two spaces and seal the spaces from each other. The clearance between the hollow rotary shaft 12 and cover tube 48 is in communication with a clearance between the forward end portion 12*a* of the hollow rotary shaft 12 and the inner cylindrical portion 6*c* of the excavating tool 6 which in turn is communicated with the passages 6*e* formed in the inner cylindrical portion 6*c*. The clearance between the hollow shaft 12 and cover tube 48 is also in communication with a forward one of the spaces defined between the bracket 42 and rotary support member 54. The bracket 42 is provided with an inlet fitting 56 for feeding the viscosity imparting liquid to the forward space defined between the bracket 42 and rotary support member 54.

The flexible shaft 46 may be formed by winding metal wires closely together in coil form, and the cover tube 48 may be formed of rubber or like material and have on its inner wall surface a coil-shaped wire of a suitable pitch to avoid wear that might otherwise be caused by contact with the flexible shaft 46 rotating at high speed.

Figure 6:
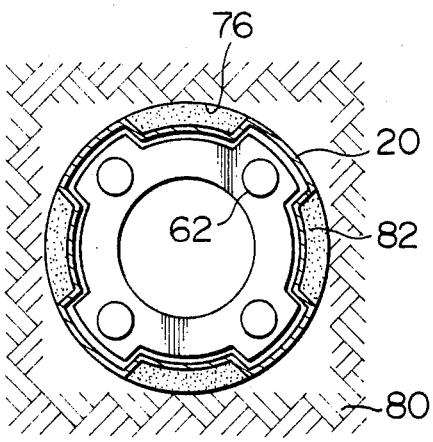
FIG. 6 is a sectional view taken along the line VI—VI in FIG. 2.

The excavator body 4 is pivotally supported at its rearward end by a forward end of the direction correcting tube 20. More specifically, as shown in FIG. 1, a convex spherical surface seat 58*a* is mounted on an outer periphery of a rearward end portion of the excavator body 4, and a concave spherical surface seat 58*b* is mounted on an inner periphery of a forward end portion of the direction correcting tube 20, the concave spherical surface seat 58*b* being complementary with the convex spherical surface seat 58*a*. The convex spherical surface seat 58*a* and concave spherical surface seat 58*b* are brought into engagement with each other and a seal 60 is mounted between the outer periphery of the excavator body 4 and the inner periphery of the direction correcting tube 20 to avoid the entry of soil into the excavator 2, and cylinders 62 for correcting the direction of movement of the excavator body 4 is mounted between the rearward end of the excavator body 4 and the direction correcting tube 20. As shown in FIG. 6, the direction correcting tube 20 is constructed such that the diameter of a portion thereof at which the direction correcting cylinders 62 are located is equal to the outer diameter of the coneshaped portion 6*a* of the excavating tool 6 and the diameter of the rest of the tube 20 is equal to the diameter of the excavator body 4.

The delivery pump mounting tube 24 is connected at its forward end to a rearward end of the direction correcting tube 20 and has mounted therein a delivery pump 64 which delivers under pressure the excavated soil into the interior of the pump mounting tube 24. An inlet port 66 for the excavated soil is formed at a bottom of a rearward end portion of the pump mounting tube 24.

Figure 3:
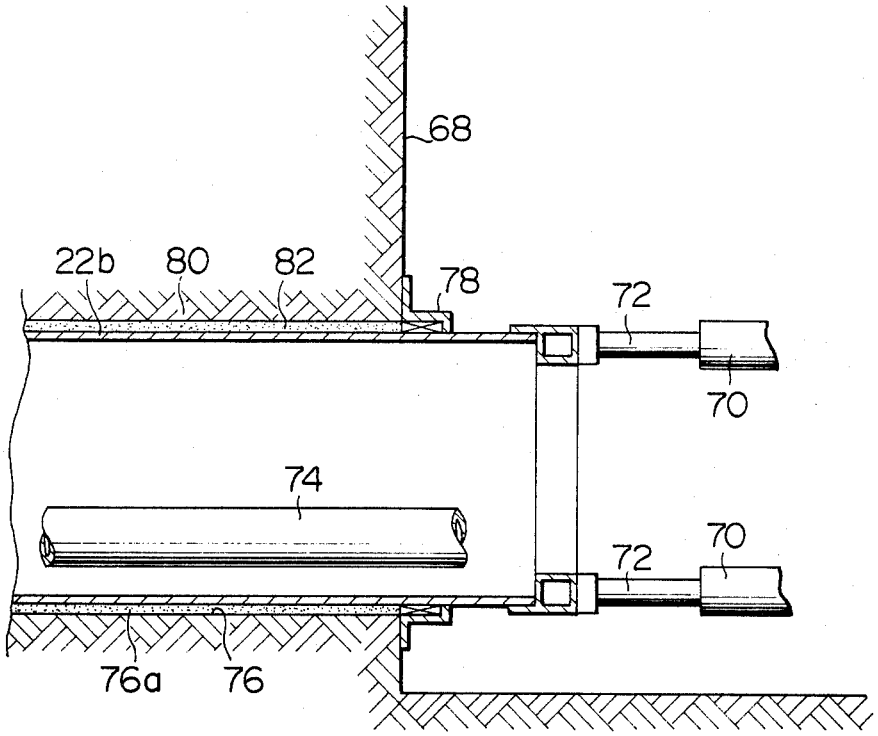
FIG. 3 is a sectional view of a pipe to be laid coupled to the delivery pump mounting tube shown in FIG. 2 and the starting pit from which the pipe to be laid is propelled.

A first pipe 22*a* to be laid is connected at its forward end to a rearward end of the delivery pump mounting tube 24, and a last pipe 22*b* to be laid is positioned at its rearward end against piston rods 72 of propelling hydraulic cylinders 70 installed in a starting pit 68 as shown in FIG. 3.

A feed tube, not shown, the viscosity imparting liquid and a delivery pipe 74 for the excavated soil are arranged to extend through the pipes 22*a* and 22*b*. The delivery pipe 74 is connected at one end thereof to the inlet port 66 and at an opposite end to a discharge unit for the excavated soil, not shown, located on the ground or in the starting pit 68. Meanwhile, the feed tube for the viscosity imparting liquid is connected at one end thereof to the inlet fitting 56 secured to the bracket 42 and at an opposite end to a viscosity imparting liquid supply system, not shown, located on the ground or in the starting pit 68. A pressure retaining frame 78 is mounted in the starting pit 68 to retain the pressure of the excavated soil in an annular clearance 76*a* defined between a hole 76 formed by the excavating tool 6 and the pipes 22*a* and 22*b* to be laid.

The embodiment of the pipe laying apparatus which is constructed as described hereinabove operates as follows.

The viscosity imparting liquid supply system is actuated to feed the viscosity imparting liquid through the viscosity imparting liquid feed tube and the inlet fitting 56 into the bracket 42, from which the liquid flows through the clearance between the inner wall surface of the hollow rotary shaft 12 and the outer wall surface of the cover tube 48 and the clearance between the inner wall surface of the increased diameter forward end portion 12*a* of the hollow rotary shaft 12 and the outer wall surface of the inner cylindrical portion 6*c* of the excavating tool 6 to the passage 6*e* in the inner cylindrical portion 6*c*. After flowing through the passage 6*e*, the viscosity imparting liquid is injected through the injecting ports 26 of the excavating tool 6 into the earth 80 to be excavated. At the same time, the first drive unit 14 for rotating the excavating tool 6 and the second drive unit 44 for rotating the rotary shaft 32 are actuated while the propelling hydraulic cylinders 70 are also actuated. The amount and concentration of the viscosity imparting liquid injected through the injecting ports 26 may be varied depending on the type of soil.

Actuation of the first drive unit 14 causes the excavating tool 6 to rotate through the hollow rotary shaft 12 and connections 18*a* and 18*b*.

Actuation of the second drive unit 44 causes the rotary shaft 32 to rotate through the flexible shaft 46. This causes the two eccentric weights 38 and 40 located on the opposite ends of the rotary shaft 32 to rotate about the sphere center of the convex and concave spherical surface seats 16*a* and 16*b* with a phase difference of 180 degrees. Thus, the rotation of the two eccentric weights 38 and 40 produces a vibratory moment which causes the excavating tool 6 to move in conical motion vibration about the sphere center 0. More specifically, as the rotary shaft 32 rotates, the eccentric weights 38 and 40 also rotate and produce centrifugal forces. The centrifugal force produced by the forwardly located eccentric weight 40 (nearer the injecting ports 26) acts upwardly and the centrifugal force produced by the rearwardly located eccentric weight 38 (remote from the injecting ports 26) acts downwardly in the plane of FIG. 1, and the two centrifugal forces constitute a couple of forces which is transmitted through the bearings 34 and 36 to the excavating tool 6. The couple of forces has a center which coincides with the sphere center 0 of the convex and concave spherical seats 16*a* and 16*b*, so that the excavating tool 6 is caused to vibrate by the couple of forces in such a manner that the second axis $X_2$ describes about the first axis $X_1$ a conical surface having a vertex at the sphere center 0. As the excavating tool vibrates in such a manner, the cover tube 48 and flexible shaft 46 are bent to follow the vibration of the excavating tool 6.

Figure 8:
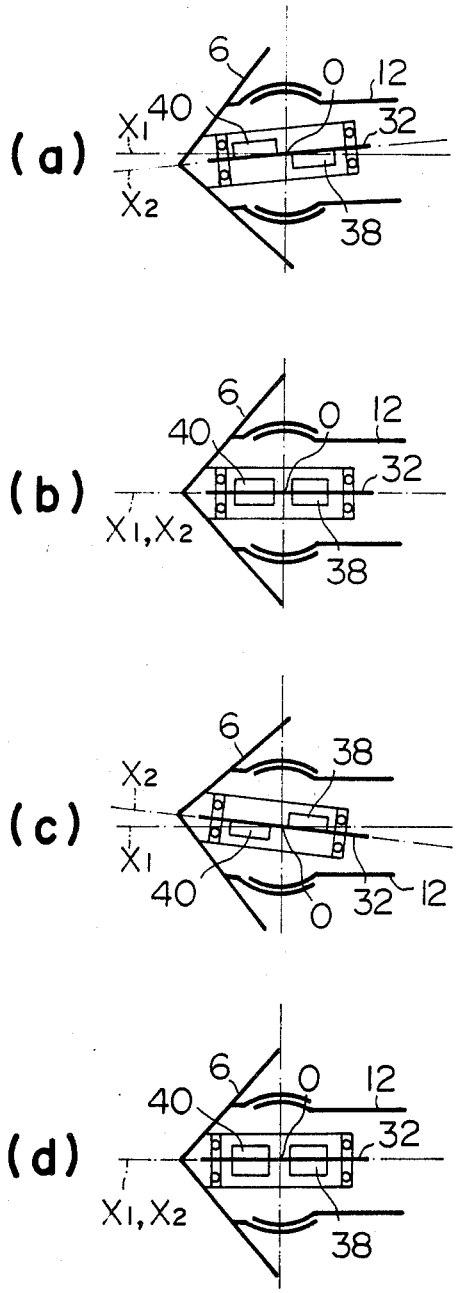
FIGS. 8(*a*)–8(*d*) are views in explanation of the conical motion vibration of the excavating tool.

The vibration in conical motion of the excavating tool 6 will be described in detail by referring to FIGS. 8(*a*)–(*d*) and 9(*a*)–(*d*).

Figure 9:
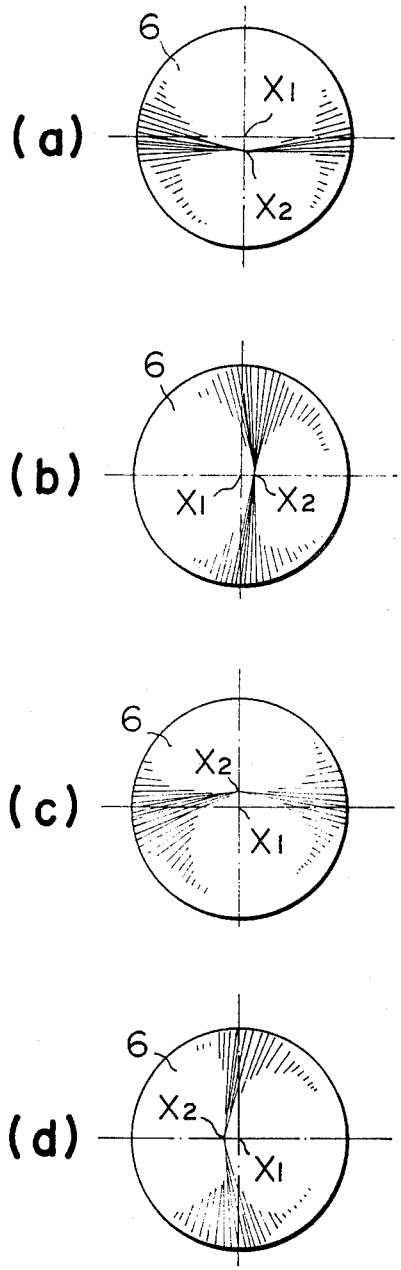
FIGS. 9(*a*)–9(*d*) a views corresponding to FIGS. 8(*a*)–8(*d*), respectively, in explanation of the conical motion vibration of the excavating tool viewed from its front.

First, assume that the rotary shaft 32 rotates counterclockwise as viewed from the front of the excavating tool 6. As the forward eccentric weight 40 is disposed above the shaft 32 and the rearward eccentric weight 38 is disposed below the shaft 32, the axis $X_2$ of the excavating tool 6 is inclined downward with respect to the axis $X_1$ of the hollow rotary shaft 12 about the sphere center 0, as shown in FIGS. 8(*a*) and 9(*a*). Then, as the forward eccentric weight 40 is disposed on the left side and the rearward eccentric weight 38 is disposed on the right side as viewed from the front of the excavating tool 6, the axis $X_2$ of the excavating tool 6 is inclined rightward with respect to the axis $X_1$ of the hollow rotary shaft 12 about the sphere center 0, as shown in FIGS. 8(*b*) and 9(*b*). Then, as the forward eccentric weight 40 is disposed below the shaft 32 and the rearward eccentric weight 38 is disposed above the shaft 32, the axis $X_2$ of the excavating tool 6 is inclined upward with respect to the axis $X_1$ of the hollow rotary shaft 12 about the sphere center 0, as shown in FIGS. 8(*c*) and 9(*c*). As the hollow rotary shaft 32 further rotates, and the forward eccentric weight 40 is disposed on the right side and the rearward eccentric weight 38 is disposed on the left side as viewed from the front of the excavating tool 6, the axis $X_2$ of the excavating tool 6 is inclined leftward with respect to the axis $X_1$ of the hollow rotary shaft 12 about the sphere center 0, as shown in FIGS. 8(*d*) and 9(*d*). As the above movement of the excavating tool 6, continues, the excavating tool 6 moves, as viewed in a sectional view taken along the axis $X_1$ of the hollow rotary shaft 12 as shown in FIGS. 8(*a*)–(*d*), in such a manner that the axis $X_2$ moves in vertical swinging motion about the sphere center 0 with respect to the axis $X_1$, and as viewed from the front of the excavating tool 6 as shown in FIGS. 9(*a*)–(*d*), in such a manner that the axis $X_2$ of the excavating tool 6 or the point of the cone-shaped portion thereof rotates counterclockwise about the axis $X_1$ of the hollow rotary shaft 12. Stated differently, the excavating tool 6 is caused to move in such a manner that its axis $X_2$ describes about the axis $X_1$ of the excavator body 4 a conical surface having a vertex at the sphere center 0. In this specification, the vibration produced by such a movement of the excavating tool 6 shall be referred to as a conical motion vibration.

In the pipe laying apparatus according to the invention, the viscosity imparting liquid fed from the viscosity imparting liquid supply system to the injecting ports 26 is injected therethrough into the surface of the earth 80 being excavated, so that a portion of the viscosity imparting liquid penetrates through the surface of the earth 80 under the injection pressure and the rest of the liquid is filled in the vicinity of the surface of the excavating tool 6. With the condition, the excavating tool 6 is rotated by the hollow rotary shaft 12 rotating at low speed while it is moved in conical motion vibration about the sphere center 0 by the rotary shaft 32 rotating at high speed. The rotary force and fine vibration are transmitted to the excavating cutters 6*b* on the surface of the excavating tool 6 and the surface of the earth 80 is excavated. At this time, the excavating tool 6 is rotated in such a manner that the surface of the earth 80 is excavated in small portions at a time or the excavating tool 6 is rotated in such a manner that the excavating cutters 6*b* make a cut of 0.5–2 mm per one revolution. Thus, the surface of the earth 80 which the viscosity imparting liquid has permeated is excavated in small portions and the soil produced by the excavation is subjected to fine vibration transmitted from the surface of the excavating tool 6 to thereby cause particles of the soil to float in the vicinity of the excavating tool 6 and to be covered with the viscosity imparting liquid existing in the vicinity of the surface of the earth 80 being excavated, thereby readily producing a viscosity imparting liquid containing soil 82 of high viscosity. The viscosity imparting liquid containing soil 82 has a specific gravity of about 1.4–1.6 and is in plastic fluidity. Thus, as a thrust is applied to the surface of the excavating tool 6 by the propelling hydraulic cylinders 70 located in the starting pit 68, the viscosity imparting liquid containing soil 82 can be readily conveyed through the outer pheriphery of the excavator body 4 to the supply port 66 of the delivery pump 64. The viscosity imparting liquid containing soil 82 of high viscosity of such a nature is filled in the annular clearance 76*a* defined between the hole 76 of an inner diameter equal to the excavating diameter of the excavating tool 6 and the pipes 22*a* and 22*b* to be laid, and the pressure of the soil 82 filled in the clearance 76*a* is watched. This makes it possible not only to avoid the cave-in of the earth 80 but also to greatly reduce the frictional resistance and adhesive resistance offered to the outer peripheral surfaces of the pipes 22*a* and 22*b* to be laid when they are propelled by the thrust applied by the hydraulic cylinders 70. The viscosity imparting liquid containing soil 82 of high viscosity having plastic fluidity can be readily delivered under pressure by the delivery pump 64 to the starting pit 68. The conical motion vibration of the excavating tool 6 causes the gravels and other solid materials to be embedded in the earth to thereby allow excavation to be carried out with a high degree of efficiency even through the gravel layer. The conical motion vibration of the excavating tool 6 is not transmitted to the excavator body 4 and pipes 22*a* and 22*b* to be laid, so that the vibratory force can be efficiently transmitted to the excavating tool 6 with a very small loss. This is conductive to a reduction in the size of the second drive unit 14 for producing the vibratory force. In the embodiment shown and described herein, the excavating tool 6 is enclosed by the excavator body 4 except for its front surface, so that the vibrating portion brought into contact with the surface of the earth 80 to be excavated is limited to the excavating surface 6*a* of the excavating tool 6 at which the conical motion vibration is converted into energy for excavation. Thus, the ground is substantially free from vibration. Moreover, the arrangement whereby the excavating tool 6 is supported by the excavator body 4 through the convex spherical surface seat 16*a* and the convex spherical surface seat 16*b* makes it possible to withstand a thrust of high magnitude (a thrust applied by the hydraulic cylinders 70). Thus, the pipe laying apparatus according to the invention is higher in efficiency than the pipe laying apparatus of the prior art relying on the rotation excavation or lateral vibration excavation alone or a combination thereof and can have application in any types of earth layers as desired.

From the foregoing description, it will be appreciated that in the pipe laying apparatus according to the invention, the excavating tool is rotated while being moved in conical motion vibration when the excavator body is propelled through the earth, and therefore the apparatus can have application in any types of earth layers, such as sand, gravel, clay, etc., and is capable of carrying out excavation with a high degree of efficiency to lay the pipes by obviating the disadvantages of apparatus of the prior art relying on the rotation excavation or lateral vibration excavation alone or a combination thereof.

What is claimed is:

1. A pipe laying apparatus comprising an excavator including an excavator body having a first axis, an excavating tool having a second axis and located at a forward end portion of the excavator body, and injection means formed in said excavating tool for injecting a viscosity imparting liquid into soil as excavated, and propulsion means located in a starting pit, said excavator body having a rearward portion thereof disposed adjacent pipes to be laid each having an outer diameter smaller than the outer diameter of said excavating tool and positioned at a rearward end thereof against said propulsion means, said excavating tool being operative to excavate the earth to form a hole therein while said viscosity imparting liquid is being injected through the injection means into the soil as excavated to thereby produce a viscosity imparting liquid containing soil which is conveyed rearwardly through an outer periphery of said excavator body while being filled in an annular clearance defined between the hole formed in the earth and the pipes to be laid, so that the pipes can be successively laid as the excavator body and the pipes propelled forwardly by said propulsion means; wherein said excavator comprises:

a first rotary shaft journalled in said excavator body for rotation about said first axis;

spherical surface seat means interposed between said excavating tool and first rotary shaft and having a sphere center located on the first axis, said excavating tool being supported through said spherical surface seat means on said first rotary shaft for allowing said excavating tool to swing in a pivotal movement about said sphere center with the second axis extending through the sphere center;

means interposed between said excavating tool and first rotary shaft for transmitting rotation of said first rotary shaft to the excavating tool while allowing the excavating tool to swing in a pivotal movement about the sphere center;

a second rotary shaft journalled in said excavating tool for rotation about said second axis;

a pair of eccentric weights mounted on said second rotary shaft and located symmetrically with respect to said sphere center while being displaced from each other by 180 degrees in phase;

first drive means connected to said first rotary shaft for driving thereof; and second drive means connected to said second rotary shaft for driving thereof.

2. A pipe laying apparatus as claimed in claim 1, wherein said first rotary shaft is a hollow shaft, and said second rotary shaft and second drive means are connected together through a flexible shaft extending through said first hollow rotary shaft.

3. A pipe laying apparatus as claimed in claim 1 or 2, wherein said excavating tool comprises a dual cylindrical structure portion having an inner cylindrical portion and an outer cylindrical portion and open at a rearward end thereof between said inner and outer cylindrical portions, said inner cylindrical portion having said second rotary shaft journalled therein for rotation, said inner and outer cylindrical portions having a forward end portion of said first rotary shaft inserted therebetween with said spherical surface seat means and said rotation transmitting means being located between said outer cylindrical portion and forward end portion of said first rotary shaft.

4. A pipe laying apparatus as claimed in claim 1, wherein said first rotary shaft is a hollow shaft defining therein a channel is communication with said injection means for allowing said viscosity imparting liquid to be supplied therethrough to the injection means.

5. A pipe laying apparatus as claimed in claim 3, further comprising a flexible cover tube rotatably supported to extend between said first hollow rotary shaft and flexible shaft with clearance being defined between the shafts and tube, said flexible cover tube having a forward end connected to said inner cylindrical portion of the excavating tool, said clearance between the first rotary shaft and flexible cover tube being in communication with a clearance between said forward end portion of the first rotary shaft and said inner cylindrical portion of the excavating tool to form a channel for allowing said viscosity imparting liquid to be supplied to said injection means.

6. A pipe laying apparatus as claimed in claim 5, wherein said inner cylindrical portion of the excavating tool has passages formed therein to communicate said channel to the injection means.

* * * * *